US007743544B2

(12) United States Patent
Laney et al.

(10) Patent No.: US 7,743,544 B2
(45) Date of Patent: Jun. 29, 2010

(54) RIFLE STOCK WITH RECOIL ABSORPTION FACILITY

(75) Inventors: Mark C. Laney, Lee, NH (US); Matthew Zglobicki, Acton, ME (US)

(73) Assignee: Thompson Center Arms Company, Inc., Rochester, NH (US)

( * ) Notice: Subject to any disclaimer, the term of this patent is extended or adjusted under 35 U.S.C. 154(b) by 178 days.

(21) Appl. No.: 11/346,800

(22) Filed: Feb. 2, 2006

(65) Prior Publication Data

US 2007/0175077 A1 Aug. 2, 2007

(51) Int. Cl.
*F41C 23/06* (2006.01)

(52) U.S. Cl. ..... 42/74; 42/75.03

(58) Field of Classification Search ..... 42/74, 42/75.03, 71.01

See application file for complete search history.

(56) References Cited

U.S. PATENT DOCUMENTS

| | | | | | |
|---|---|---|---|---|---|
| 837,455 | A | * | 12/1906 | Duncan | 42/74 |
| 1,414,116 | A | * | 4/1922 | Dewhurst | 42/74 |
| 1,642,835 | A | * | 9/1927 | Ammann | 42/74 |
| 1,729,514 | A | * | 9/1929 | Lorimer | 42/74 |
| 2,300,738 | A | * | 11/1942 | Ammann | 42/73 |
| 3,491,473 | A | * | 1/1970 | Eastin | 42/74 |
| 4,512,101 | A | * | 4/1985 | Waterman, Jr. | 42/71.01 |
| 4,674,216 | A | * | 6/1987 | Ruger et al. | 42/71.01 |
| 4,854,065 | A | | 8/1989 | French et al. | |
| 5,235,765 | A | * | 8/1993 | Chesnut | 42/74 |
| 5,471,776 | A | * | 12/1995 | Chesnut et al. | 42/74 |
| 5,615,507 | A | | 4/1997 | French | |
| 5,639,981 | A | | 6/1997 | French | |
| 5,680,722 | A | | 10/1997 | French et al. | |
| 5,782,030 | A | | 7/1998 | French | |
| 5,813,157 | A | * | 9/1998 | Scott et al. | 42/71.01 |
| 5,907,920 | A | | 6/1999 | Laney | |
| 6,012,246 | A | * | 1/2000 | Robinson et al. | 42/71.01 |
| 6,145,235 | A | | 11/2000 | Emerson et al. | |
| 6,219,951 | B1 | | 4/2001 | Cate | |
| 6,301,817 | B1 | * | 10/2001 | Hogue et al. | 42/71.01 |
| 6,305,115 | B1 | * | 10/2001 | Cook | 42/74 |
| 6,532,692 | B2 | | 3/2003 | Cate | |
| 6,604,311 | B1 | | 8/2003 | Laney et al. | |
| 6,834,455 | B2 | * | 12/2004 | Burigana | 42/74 |
| 7,140,138 | B1 | | 11/2006 | Laney et al. | |
| 7,257,917 | B1 | | 8/2007 | Garland | |
| 2006/0168868 | A1 | * | 8/2006 | Phillips | 42/71.01 |
| 2006/0248771 | A1 | | 11/2006 | Richards | |
| 2007/0137084 | A1 | | 6/2007 | Laney et al. | |
| 2007/0163162 | A1 | | 7/2007 | Laney et al. | |

* cited by examiner

*Primary Examiner*—Stephen M Johnson
(74) *Attorney, Agent, or Firm*—McCormick, Paulding & Huber LLP

(57) ABSTRACT

A rifle stock has an elongated body with a forward end and a butt end. The upper and lower edges of the stock are solid and continuous from front to rear. A slot generally parallel to the butt plate is formed adjacent to the butt plate to allow limited flexing in response to recoil. The stock may be formed as a hollow shell with opposed side walls, with slots to find in each sidewall. Several parallel slots may be defined in each sidewall. The slots may be occupied by elastomeric elements.

15 Claims, 2 Drawing Sheets

RIFLE STOCK WITH RECOIL ABSORPTION FACILITY

FIELD OF THE INVENTION

This invention relates to firearms, and more particularly to stocks for rifles.

BACKGROUND AND SUMMARY OF THE INVENTION

Higher power rifle calibers generate a recoil force against the shooter's shoulder that is perceived as uncomfortable, painful, or even injurious by least some shooters. A rifle typically generates a sharp force transient in reaction to a shot being fired. The sharpness of this force, or the rapid impulse of the recoil, increases the perception of recoil.

Many approaches have been taken to reduce perceived recoil. Compressible materials have been used, either in the form of padding on the shooter's shoulder, or on a butt-pad or attachment for the rear of the rifle stock. However, compressible materials such as soft rubber tend to degrade over time from use, and are readily damaged by harsh conditions in the field.

One approach to reducing recoil is in the form of a rifle stock with a rear end portion that is axially sprung with respect to the front end that supports the rifle action. One such method is disclosed in U.S. Pat. No. 6,834,455 to Burigana, which discloses a stock having a diagonal pattern of slots. The pattern extends from the upper rear to the lower front of the stock. This essentially divides the stock into front and rear portions, which are connected only by a number of slim spring-like elements, without any rigid connection. While possibly suitable for some applications, the diagonal pattern creates an angled response to axial forces, generating unexpected vertical motion in recoil. Further, while recoil absorption may be achieved, the design severs structural integrity between the stock portions, reducing rigidity where it might be sired, such as at the upper edge of the stock where a firm cheek rest is desired. By suspending the entire rear portion, structural integrity is compromised when flexibility is needed only for a limited part of the butt stock where the shoulder contacts.

The present invention overcomes the limitations of the prior art by providing a rifle stock having an elongated body with a forward end and a butt end. The upper and lower edges of the stock are solid and continuous from front to rear. A slot generally parallel to the butt plate is formed adjacent to the butt plate to allow limited flexing in response to recoil. The stock may be formed as a hollow shell with opposed side walls, with slots to find in each sidewall. Several parallel slots may be defined in each sidewall. The slots may be occupied by elastomeric elements.

DETAILED DESCRIPTION OF A PREFERRED EMBODIMENT

Figure 1:
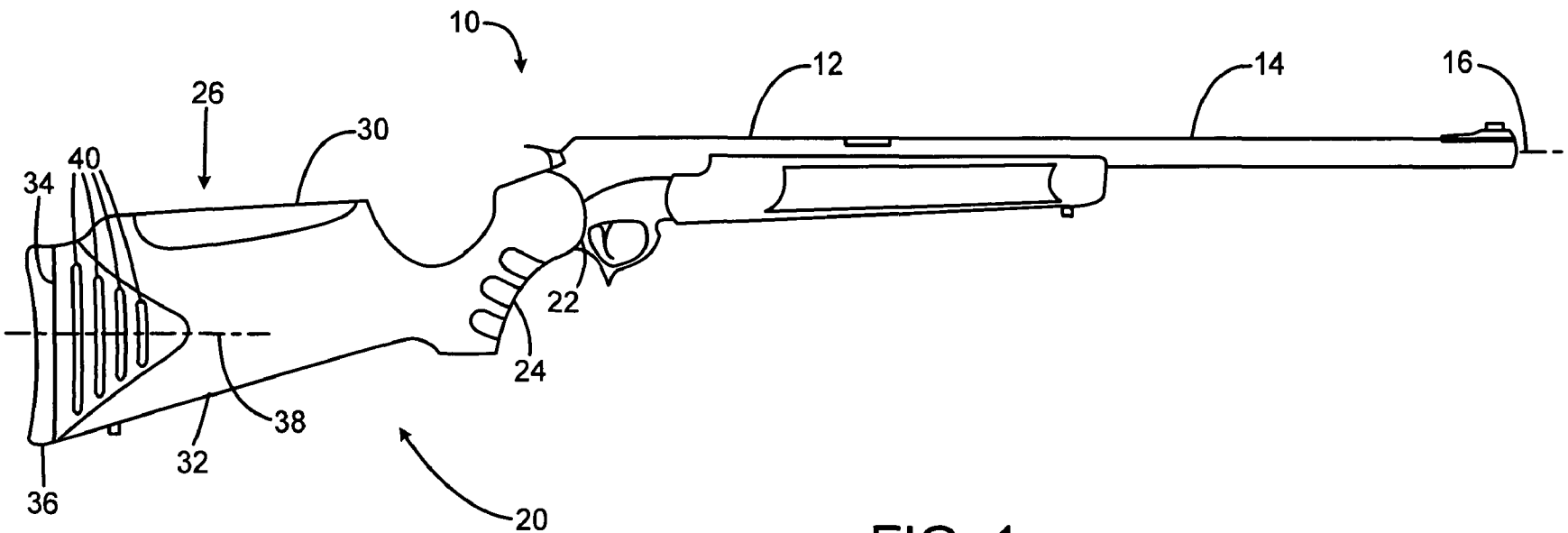
FIG. 1 is a side view of a firearm with a rifle stock according to a preferred embodiment of the invention.

FIG. 1 shows a single shot rifle 10 having a receiver 12 with an extending barrel 14. The barrel defines a barrel axis 16. A rifle stock 20 is connected to a rear portion of the receiver 12.

The stock has a forward portion 22, a pistol grip portion 24, and an elongated body 26 having an upper edge 30, a lower edge 32, and a butt end 34. A butt plate 36 is connected to the butt end 34. The butt plate is a plastic plate of moderate flexibility, with an elastomeric covering on its rear surface to provide some cushioning and slippage resistance. Just forward of the butt end 34, a plurality of slots 40 are defined in the side walls of the butt stock. The stock defines a major axis 38 that is perpendicular to the plane of the butt end 34, and approximately parallel to the barrel axis 16, except to the extent that the butt end is slightly offset from perpendicular to the barrel axis.

Figure 2:
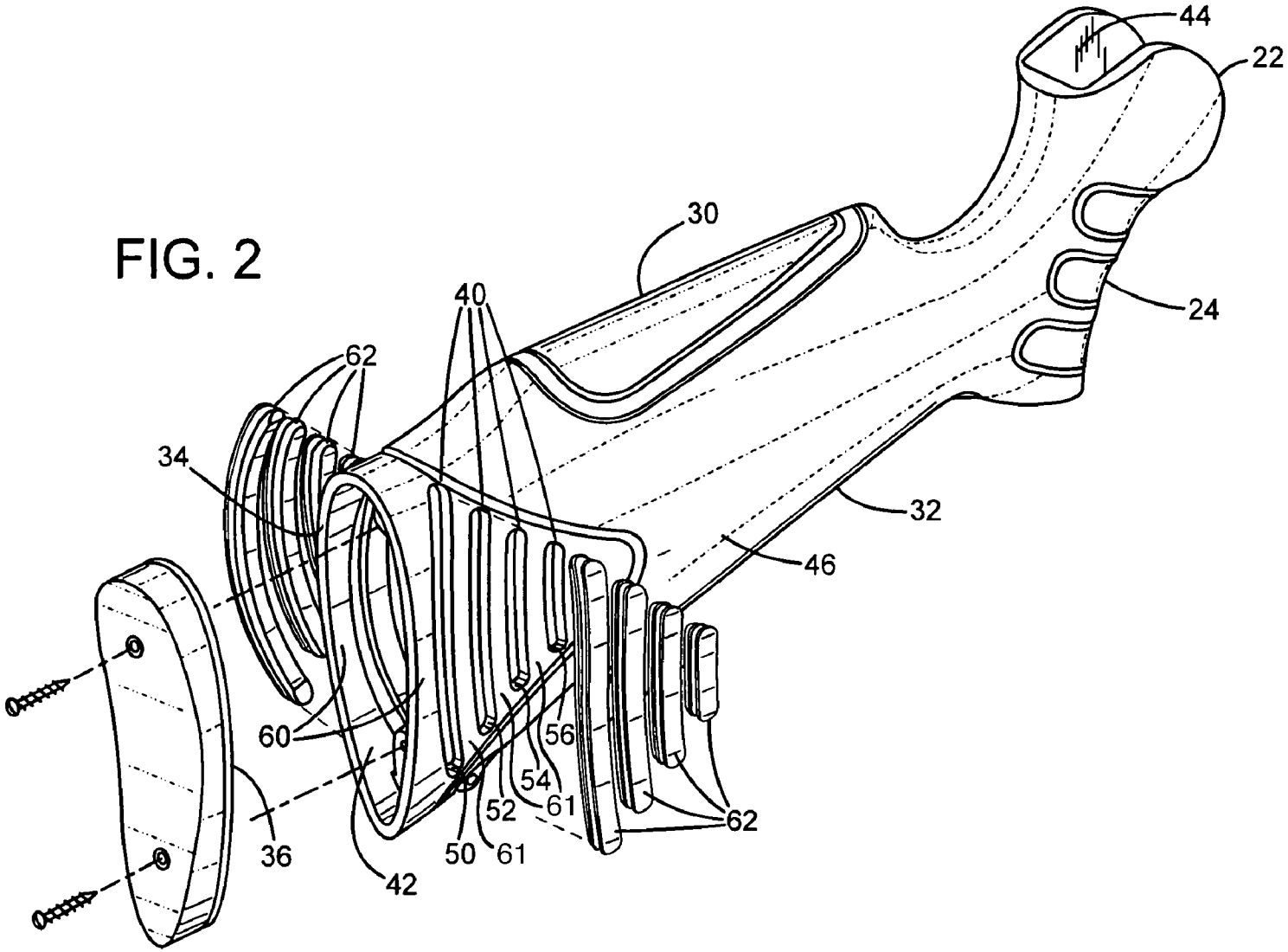
FIG. 2 is an exploded perspective view of a rifle stock according to the preferred embodiment of the invention.

As shown in FIG. 2, the stock is a hollow molded plastic body in the form of a contoured tube or shell, with the shell having a nearly continuous and solid wall surface from a rear opening 42 to a receiver receptacle 44. This provides strength and rigidity, with the stock being formed of reinforced thermoplastic, such as glass-loaded polypropylene. The upper edge 30 or comb of the stock is a solid continuous span between the front end 22 and the butt end 34. This provides compression strength and stability, including during aiming, as well as in recoil. The lower edge is a similarly continuous span that provides rigidity against significant compression, even in resistance to forces during firing.

To provide for some limited localized flexibility of the stock to reduce the perceived forces of recoil for a shooter, the sidewalls 46 of the stock are formed with the slots 40. The slots are gently curved arcs, arranged in an array on each side adjacent to the butt end 34. In each array, the slot 50 nearest the butt is longest, and the slots 52, 54 are progressively shorter toward the forward-most slot 56. The ends of the slots form a tapering wedge or triangle. The end of each slot is semi-circular to avoid excessive stress concentrations. In a molded stock, the fibers entrained in the plastic material will tend to align with the contours of the curves, further increasing strength. The arrays are the same on each side of the stock. The longest, rearmost slot 50 extends nearly the entire height of the stock, ending just short of the upper and lower edges so that the stock has structural integrity at the upper and lower edges.

The stock has a flexible rear span portion 60 forming the rearmost portion of the sidewalls 46 adjacent to the butt end with upper and lower ends of the span 60 solidly joined to the stock 20 while a middle portion of the span 60 is suspended apart from the side walls 21 of the stock. The span on each side is defined at the rear by the rim of the butt end 34, and in a forward direction by the largest slot 50. Because the slot 50 is an arc with a concave-forward shape, the span 60 is tapered toward the middle or intermediate portion, wider at its ends than at its middle. This provides for added flexibility in the middle, where the convex forward portion of a shooter's shoulder contacts the stock. The further spans 61 formed between the other slots add flexibility, without compromising axial rigidity along the upper and lower edges.

Each slot is occupied by an elastomeric insert 62 sized to closely fit within the slot. The inserts are formed of rubber or an alternative elastomeric material such as urethane. The inserts serve to dampen vibration and flexing of the spans, so that flexing occurs only in response to a sharp transient of recoil forces. In addition, the inserts further provide a gripping surface, and block the slots against incursion of dirt and debris.

In the preferred embodiment, the stock is about 12.687 inches long, and has a nominal wall thickness of 0.160 inches. The height at the butt end (which is the length of the butt along a vertical line from the rears of the upper and lower stock edges) is 5.0 inches. The slots 50-56 have respective lengths of 4.0, 3.125, 2.218, and 1.265 inch. The slots have widths of 0.250 inch, and the spans between the slots have a width of 0.3125 inch. The rear span 60 has a width of 0.3125 inch at the middle, and 0.60 inch at the ends. The first slot 50 has a length of 80% of the height of the stock at that location, providing significant flexibility without compromising the structure of the stock. The spans have typical aspect ratios of length-to-width in the range of 4 to 12.

While the above is discussed in terms of preferred and alternative embodiments, the invention is not intended to be so limited. For instance, the stock need not be formed as a shell, but may be a solid body such as formed of wood, or filled fiberglass. In such variants, the slots would extend entirely through the stock. In other alternative embodiments, the rubber inserts could be omitted, or could be replaced with alternate material having softer or stiffer properties. The slots are shown as arcs concave forward, but may be concave rearward, straight, or wavy lines, or any other elongated shape, as long as they generally extend from top to bottom, generally parallel to the butt plate, so that the middle portion of the butt plate is suspended while the upper and lower ends of the butt plate are solidly connected to the stock.

The invention claimed is:

1. A rifle stock comprising: a hollow stock body having a longitudinal axis and a butt end defining a butt plane; a forward end opposite the butt end; an upper edge extending between the butt end and the forward end; a lower edge extending between the butt end and the forward end; and opposed sidewalls having a thickness extending from the upper edge to the lower edge and from the butt end to the forward end and together enclosing an inner volume opened at the butt end of said hollow stock body; each sidewall including an elongated opening formed between the upper and lower edges adjacent to the butt end, the elongated opening having upper and lower ends disposed on a line substantially parallel to the butt plane and extending the majority of a butt end height measured along said line.

2. The stock of claim 1 wherein each opening extends through the thickness of the sidewall to open on the inner volume.

3. The stock of claim 1 further comprising an array of adjacent elongated openings formed in the opposed sidewalls and defining elongated spans of stock material extending between the upper and lower edges, wherein the openings formed in each sidewall adjacent the butt end are the first openings in each array.

4. The stock of claim 3, wherein the openings are curved arcs that are concave toward the forward end of the stock.

5. The stock of claim 3 wherein the openings diminish in length from the butt end toward the forward end.

6. The stock of claim 1, wherein each sidewall includes a butt end span continuous between the upper and lower edges.

7. A firearm assembly comprising:

a hollow rifle stock body defining a major axis; the stock body having a butt end, a forward end opposed to the butt end, upper and lower edges extending between the butt end and the forward end, and sidewalls extending from the butt end to the forward end between the upper and lower edges to enclose an inner volume therebetween, the butt end having a height measured between the upper and lower edges, and defining a butt plane substantially perpendicular to the major axis; and the stock body having an array of elongated slots formed in the sidewalls and opening on the inner volume, each slot being generally parallel to the butt plane, the array of slots being arranged side-by-side along the major axis.

8. The firearm assembly of claim 7 wherein at least one of the slots has a length greater than one half of the butt end height.

9. The firearm assembly of claim 7 wherein the slots are occupied by an elastomeric material.

10. A rifle stock comprising: an elongated hollow body having a forward end and a butt end; an upper edge of the body extending between the forward end and the butt end; a lower edge of the body extending between the forward end and the butt end; opposed sidewalls extending from the butt end to the forward end between the upper and lower edges to enclose an inner volume of the hollow body; and an elongated flexible span adjacent the butt end and solidly joined to the upper and lower edges of the body at the upper and lower ends of the span, a middle portion of the elongated span being suspended between said upper and lower ends and being tapered so as to be narrower at an intermediate portion thereof, wherein each sidewall defines an array of elongated openings, the openings progressively decreasing in length based on their distance from the butt end.

11. A rifle stock comprising: a hollow stock body having a longitudinal axis and a butt end defining a butt plane; a forward end opposite the butt end; an upper edge extending between the butt end and the forward end; a lower edge extending between the butt end and the forward end; opposed sidewalls having a thickness extending from the upper edge to the lower edge bounded by the butt end and the forward end; and an elongated opening formed in each sidewall adjacent to the butt end and having upper and lower ends thereof disposed on a line substantially parallel to a plane defined by the butt end, wherein each elongated opening is occupied by an elastomeric insert sized to closely fit within each elongated opening.

12. The stock of claim 11 wherein each opening extends through the thickness of the sidewall.

13. The stock of claim 11, wherein each elongated opening adjacent to the butt end is a first of an array of adjacent elongated openings formed in the opposed sidewalls and separating elongated spans of stock material extending between the upper and lower edges of the stock, the array extending forward from the butt end along the longitudinal axis.

14. The stock of claim 13, wherein at least some of the openings are curved arcs that are concave toward the forward end of the stock.

15. The stock of claim 13 wherein the openings diminish in length from the butt end toward the forward end.

* * * * *